US006826887B2

(12) United States Patent
Skov

(10) Patent No.: US 6,826,887 B2
(45) Date of Patent: Dec. 7, 2004

(54) PLASTIC BLOW-MOLDED PANEL WITH IMPROVED STRUCTURAL GEOMETRY

(75) Inventor: Erik L. Skov, Akron, OH (US)

(73) Assignee: Rubbermaid Incorporated, Wooter, OH (US)

( * ) Notice: Subject to any disclaimer, the term of this patent is extended or adjusted under 35 U.S.C. 154(b) by 5 days.

(21) Appl. No.: 10/376,803

(22) Filed: Feb. 28, 2003

(65) Prior Publication Data

US 2004/0168394 A1 Sep. 2, 2004

(51) Int. Cl.[7] ..... E03C 2/34

(52) U.S. Cl. ..... 52/793.1; 52/630; 108/57.28; 108/901; 428/167; 428/178

(58) Field of Search ..... 52/630, 793.1, 52/309.1, 790.1, 179, 177; 108/57.28, 901; 428/167, 120, 178, 188

(56) References Cited

U.S. PATENT DOCUMENTS 3,980,123 A 9/1976 Vago
4,397,247 A * 8/1983 Lemelson ..... 108/57.1
4,762,379 A * 8/1988 Beam et al. ..... 312/348.6
5,368,380 A * 11/1994 Mottmiller et al. ..... 312/263
5,704,699 A 1/1998 Pagelow et al.

OTHER PUBLICATIONS

International Search Report dated Mar. 5, 2004 (3 pages).

* cited by examiner

*Primary Examiner*—Naoko Slack
(74) *Attorney, Agent, or Firm*—Marshall, Gerstein & Borun LLP

(57) ABSTRACT

An improved plastic blow-molded panel structure is shown and described that is lightweight and provides superior resistance to sagging, warping and creeping under high stress loads, especially when used in a horizontal position. The disclosed panel structure includes a combination of transverse or lateral beams extending from the second panel towards the first panel and, in certain embodiments, a plurality of transverse ribs disposed within the lateral beams. The disclosed shelving units may be fabricated from conventional blow-molding processes.

44 Claims, 5 Drawing Sheets

PLASTIC BLOW-MOLDED PANEL WITH IMPROVED STRUCTURAL GEOMETRY

TECHNICAL FIELD

A plastic panel structure fabricated by way of a blow-molding process is shown and described. More specifically, a substantially hollow and lightweight blow-molded plastic panel structure is disclosed with a structural geometry that increases the load capacity of the panel structure and further resists creeping, sagging and warpage under high load conditions.

BACKGROUND OF THE RELATED ART

Plastic panels and blow-molded panels are known in the art and may be combined with support structures to form a complete shelving or storage unit. The consumer appeal to plastic shelving systems includes two competing interests. Specifically, consumers prefer that the panel structures and shelving systems be lightweight but consumers also demand that the shelving systems be strong and durable or, in other words, have relatively high load capacities. Low cost is also a general concern.

However, current designs that are lightweight and are fabricated from a minimum of plastic material, thereby lowering the cost of the article, can suffer from the drawback of lower load capacity and may also suffer from sagging, creeping and warpage under high load conditions, especially when used as a horizontal shelf. Specifically, heavy loads placed on a lightweight panel structure can cause creeping, sagging or warping due to the panel structure's ability to withstand the load due to the insufficient wall thickness and insufficient weight of the panel structure. As a result, the panel structure can creep, sag or warp thereby interfering with the panel structures inability to interact with the other components of the system, namely the support components. Further, lightweight blow-molded panel structures have been known to fail under typical higher load conditions thereby causing frustration to the user and possible damage to the goods stored thereon.

In an attempt to the increase the load capacity of plastic blow-molded panel structures, manufacturers have resorted to making the panel structures heavier, thereby adding wall thickness and using more material, thereby driving up the costs. Other solutions include additional separate bracket components to improve the product performance. Using additional materials increases the cost and the weight which is not preferred. Further, using additional bracket or bracing components adds to the complexity of the shelving systems which makes them difficult to assemble and results in additional competition with more complex metal or wooden shelving systems.

Therefore, there is a need for an improved lightweight plastic blow-molded panel structure and accompanying system which is lightweight, inexpensive, easy to use and which is capable of withstanding high loads without creeping, sagging or warping when used in a horizontal or vertical position.

SUMMARY OF THE DISCLOSURE

In satisfaction of the aforenoted needs, a plastic panel structure is disclosed which comprises a first panel and a second panel spaced apart from the first panel. The second panel comprises a plurality of lateral beams extending upward from the second panel and towards the first panel to connect the second panel to the first panel. Each beam defines a lateral slot through the second panel and towards the first panel.

In a refinement, the second panel further comprises a plurality of transverse ribs with each transverse rib extending through one of the lateral slots.

In a refinement, the first panel further comprises a plurality of lateral grooves with each groove of the first panel being in alignment with one of the lateral beams of the second panel.

In a further refinement, the first panel is arched upward away from the second panel while the second panel is flat or substantially flat.

In another refinement, the first panel is connected to the second panel by a front wall and a rear wall wherein the front wall is arched. In yet another refinement, the first panel is connected to the second panel by two opposing sidewalls, both of which are connected to the front and rear walls.

In another refinement, each transverse rib has an average lateral width. The average lateral width of the transverse ribs disposed toward a lateral center of the first panel is greater than an average lateral width of the transverse ribs disposed closer to the front or rear walls. As a result, the ribs disposed toward the center of the panel structure are thicker and stronger than those disposed towards the front and rear ends of the panel structure.

In yet another refinement, each transverse rib has a bottom edge that extends from one side of its respective lateral slot to an opposite side thereof and each bottom edge of each rib is arched upwards towards the first panel to minimize material consumption.

In another related refinement, each transverse rib has a top edge that extends from one side of its respective lateral slot to the opposite side thereof. The top edge of each rib being arched downward, away from the first panel to minimize material consumption.

Preferably, the panel structures are made from a blow-molding process.

BRIEF DESCRIPTION OF THE DRAWINGS

The disclosed embodiments are described more or less diagrammatically in the accompanying drawings, wherein.

It should be understood that the drawings are not necessarily to scale and that the embodiments disclosed therein are illustrated by diagrammatic representations and fragmentary views. In certain instances, details which are not necessary for an understanding of this disclosure or which render other details difficult to perceive may have been omitted. It should be understood, of course, that this disclosure is not necessarily limited to the particular embodiments illustrated herein.

DETAILED DESCRIPTION OF THE PRESENTLY PREFERRED EMBODIMENTS

Figure 1:
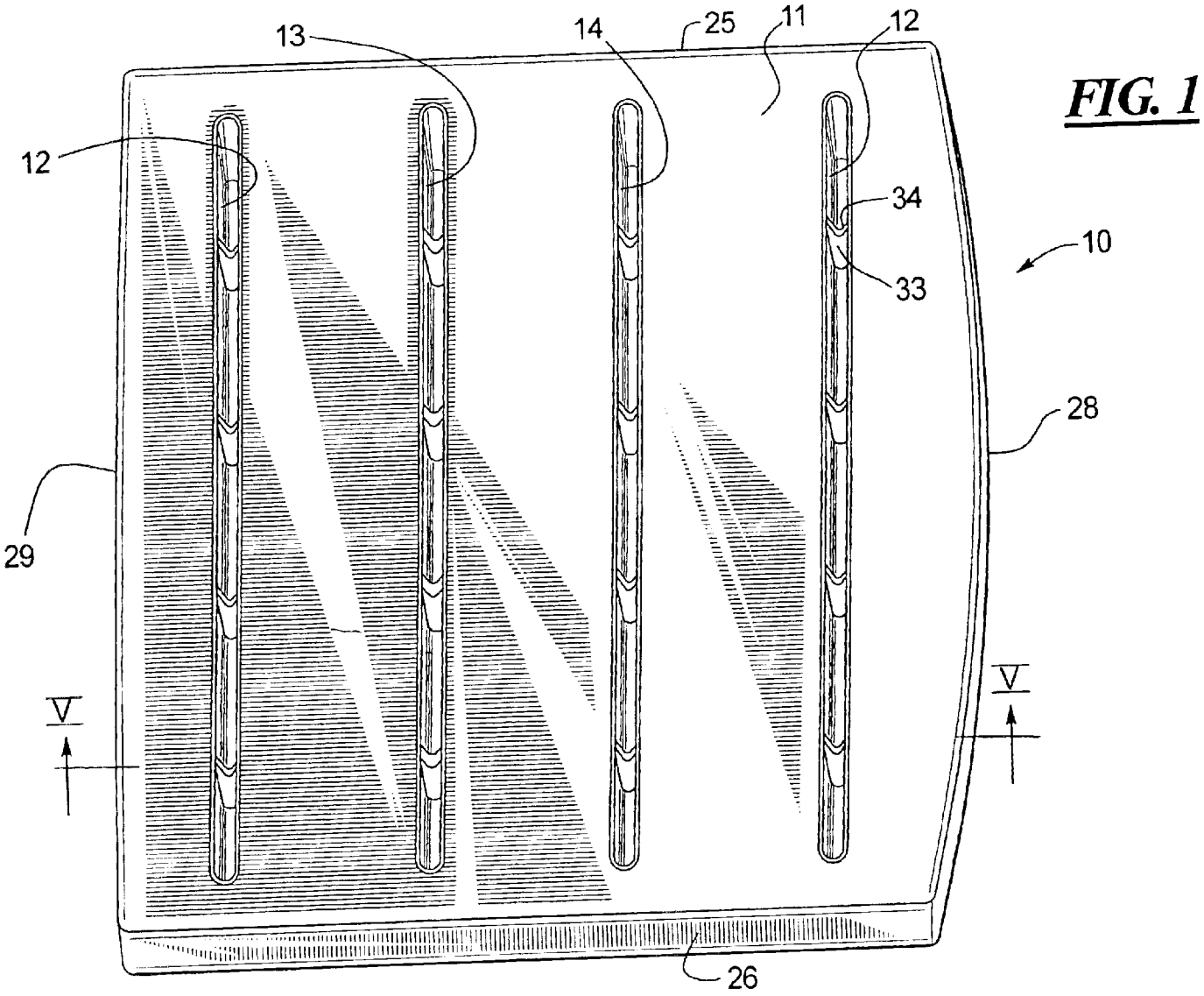
FIG. 1 is a bottom perspective view of a plastic blow-molded panel structure made in accordance with this disclosure.
Figure 2:
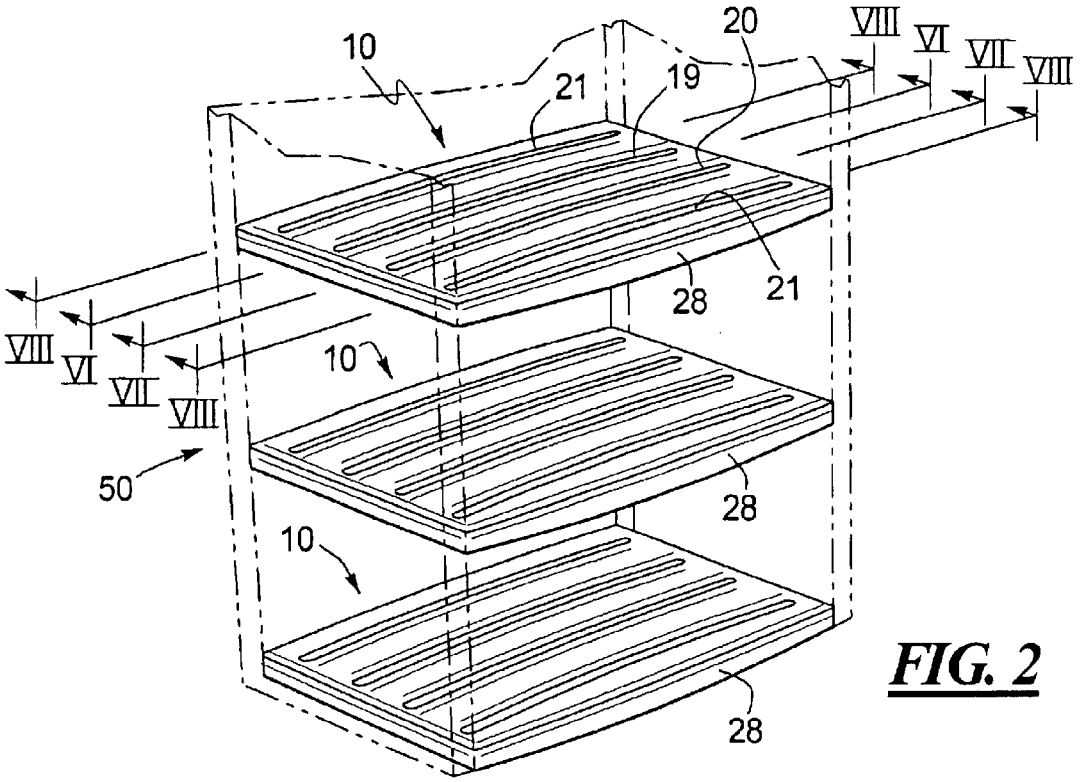
FIG. 2 illustrates three panel structures as exemplified in FIG. 1 assembled in a shelving unit.
Figure 6:
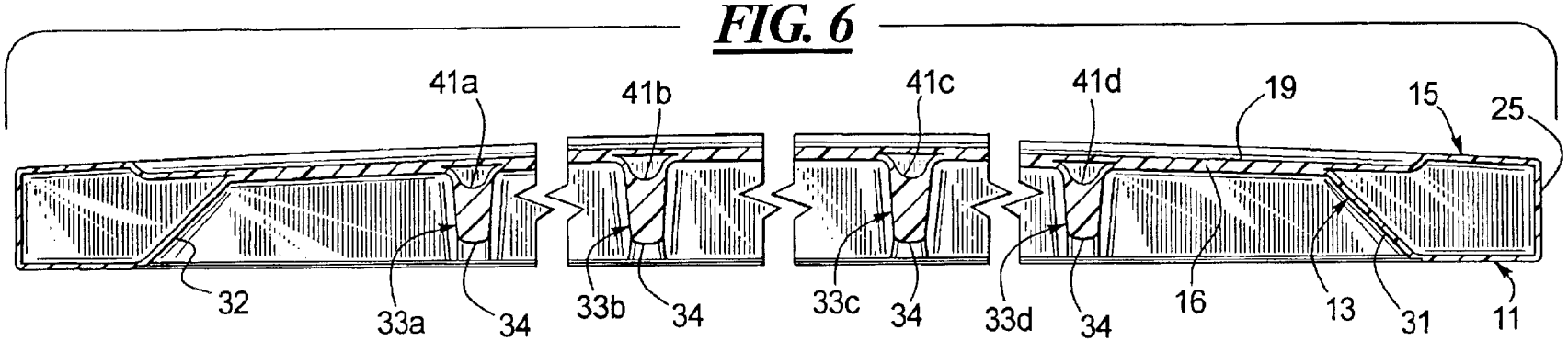
FIG. 6 is a sectional view taken along line 6—6 of FIG. 2.
Figure 7:
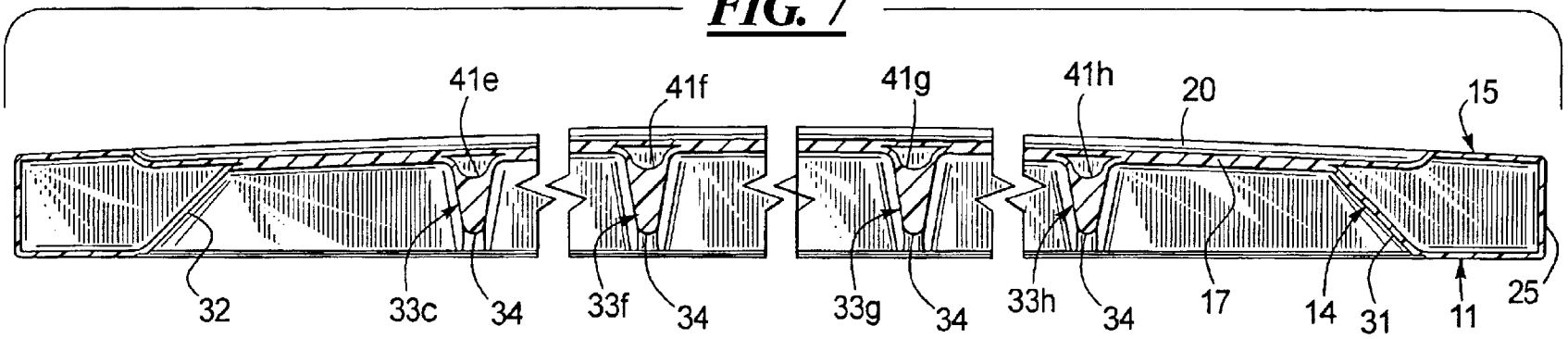
FIG. 7 is a sectional line taken along line 7—7 of FIG. 2.
Figure 8:
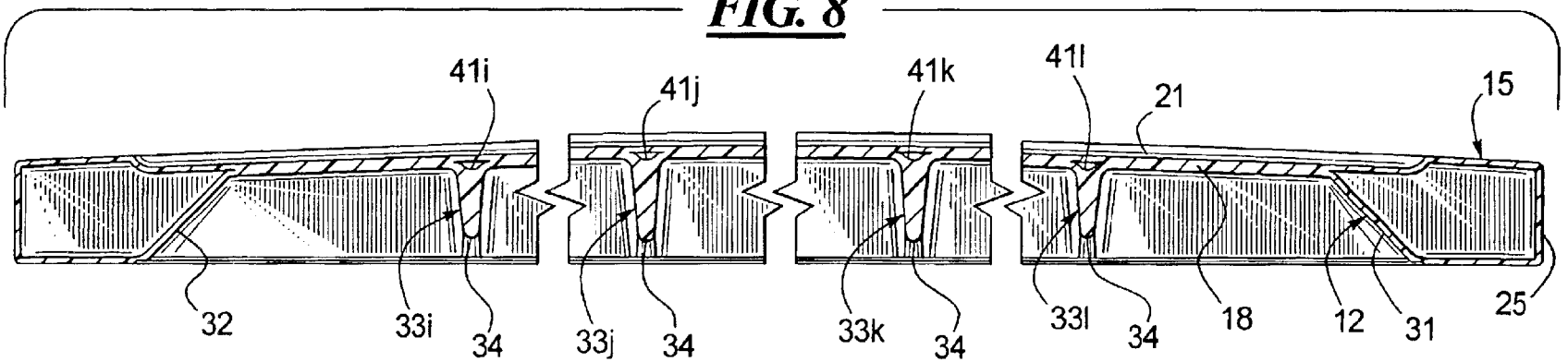
FIG. 8 is a sectional view taken along lines 8—8 of FIG. 2.

A bottom perspective view of a panel structure 10 made in accordance with this disclosure is illustrated in FIG. 1. A second panel 11 of the panel structure 10 includes a plurality of lateral slots which are shown at 12–14 in FIG. 1. Two lateral slots are shown at 12 because the geometry of these slots is substantially similar as discussed below. As shown in FIGS. 2 and 6–8, the slots 12–14 define a hollow lateral beam that extends outward from the second panel 11 to the first panel 15. In the embodiments illustrated, the lateral beams 12–14 are connected to the first panel 15 at the thickened areas shown at 16–18 in FIGS. 6–8. The thickened areas 16–18 are also defined by lateral grooves or slots 19–21 disposed in the first panel 15 as best seen in FIG. 2. The lateral beams defined by the slots 12–14 do not extend laterally all the way across the second panel 11, but, instead, stop short of the sidewalls shown at 25–26. FIGS. 6–8, and perhaps better in FIG. 4, also show that the first panel 15 is arched upward away from the second panel 11. The arched first panel 15 provided additional structural integrity and resistance to sagging under high loads when the panel structure 10 is used as a horizontal shelf (see FIG. 2) with the first panel 15 as a top panel.

Figure 4:
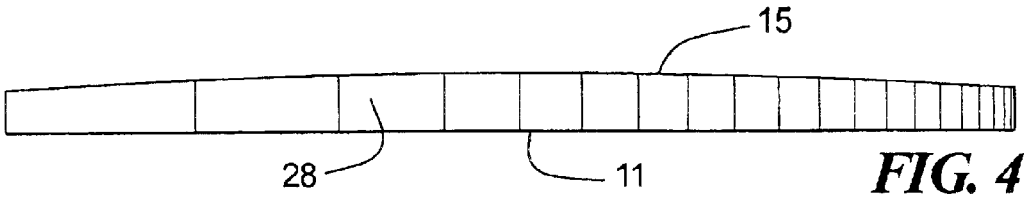
FIG. 4 is a front end elevational view of the panel structure shown in FIG. 1.
Figure 5:
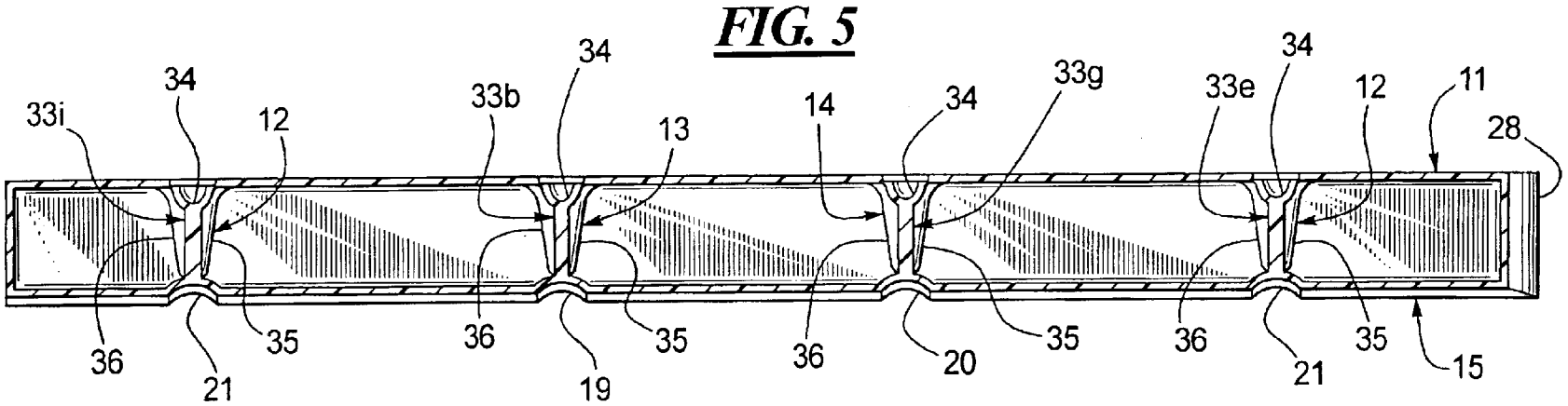
FIG. 5 is a sectional view taken along line 5—5 of FIG. 1.

It will be also noted from FIGS. 2, 4 and 5 that the first panel 15 and second panel 11 are connected to a front panel 28 and a rear panel 29. The front panel 28 may be curved for aesthetic purposes and improve the structural integrity of the panel structure 10.

Referring to FIGS. 5–8, each lateral slot 12–14 defines a lateral beam, also indicated at 12–14 in FIGS. 6–8. Each beam 12–14 includes inclined walls 31, 32 that extend upwardly from the flat portions of the second panel 11 and connected the second panel 11 to the first panel 15. Each lateral beam 12–14 also includes a plurality of transverse ribs shown at 33*a*-331 in FIGS. 6–8.

As shown in FIG. 5, each transverse rib 33 also connects the second panel 11 to the first panel 15 or, more specifically, the second panel 11 to one of the lateral slots 19–21 in the first panel 15. To conserve material costs while also improving structural integrity, each transverse rib 33 includes a lower arched edge 34 and upper arched edges 41*a*–41*l* (see FIGS. 6–8) as each rib 33 extends from a front side 35 of its respective beam 12, 13 or 14 (see FIG. 5) to the rear side 36 of its respective beam 12, 13 or 14. The transverse ribs 33 further enhance the structural integrity of the panel structure 10 and supplement the structural integrity enhancement provided by the lateral beams 12–14. The arched lower portions 34 and upper portions 41 of the transverse ribs 33 also add to the structural integrity of the structure 10 while further minimizing material consumption and thereby contributing to the lightweight of the panel structure 10.

Figure 9:
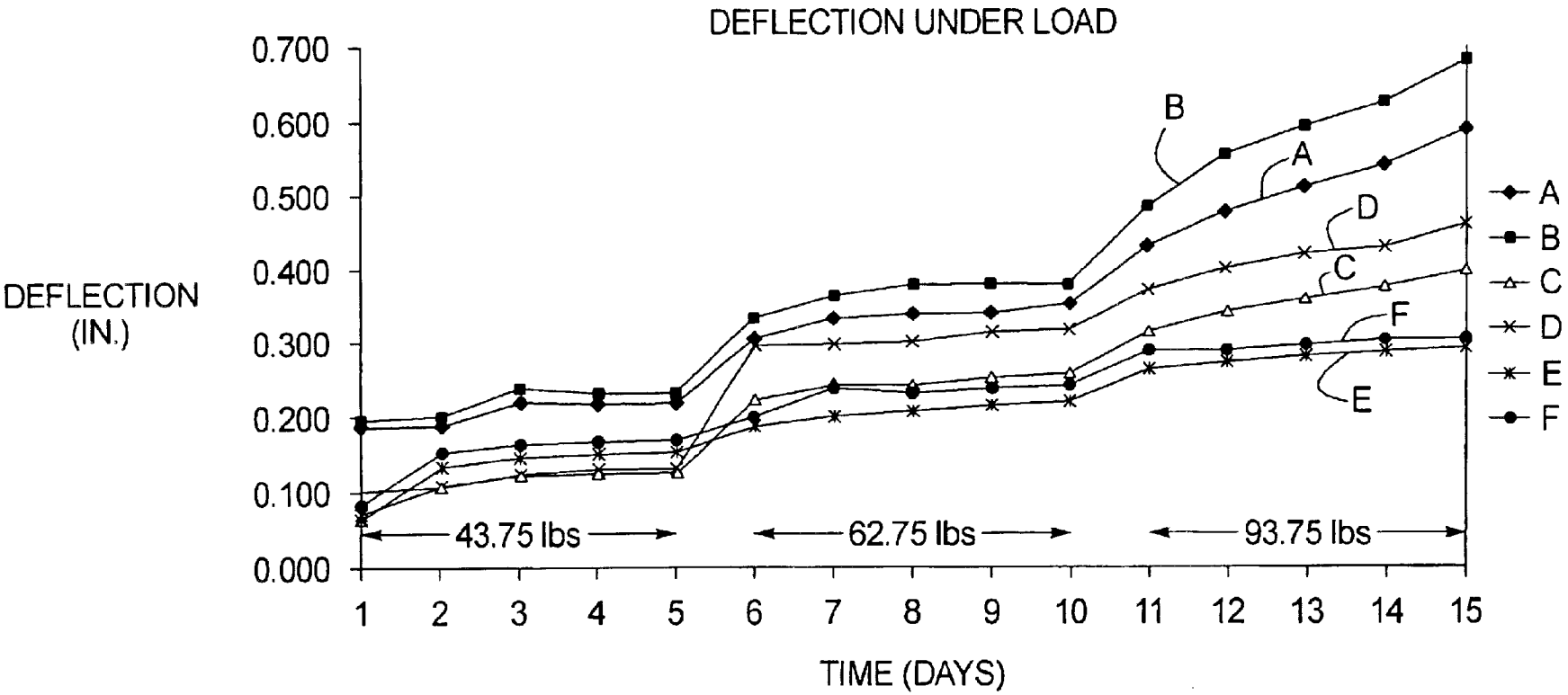
FIG. 9 illustrates graphically the horizontal load test performance of four panel structures made in accordance with this disclosure versus two conventional panel structures over a fifteen day period and under increasingly heavy test loads.

The improved structural integrity of the panel structure 10 is demonstrated by the data provided in FIG. 9 and below. Six different blow-molded panel structures were produced and tested. Panel structure A is a conventional panel structure, weighing 2.67 lbs, and lacking the lateral beams 12–14, transverse ribs 33 and slots 19–21 in the first panel. A similar conventional panel structure B was also tested with the same design features as panel structure A but weighing 2.5 lbs. Two panel structures C and D were also produced with the lateral beam structures 12–14 shown in the drawings but without the transverse ribs. Panel structures C and D did, however, include the lateral slots 19–21 in the first panel 15. Panel structure C weighs 2.36 lbs. while panel structure D weighs 2.37 lbs. Finally, two additional panel structures E and F were produced with the design features illustrated in the drawings. That is, with the lateral beams 12–14 and the second panel 11, the lateral slots 19–21 in the first panel 15 and the transverse ribs 33 as shown. Panel structure E weights 2.10 lbs. and panel structure F weights 2.20 lbs., less than panel structures A–D.

The six panel structures A–F were tested over a 15 day period. For the first five days, a load of 43.75 lbs. was imposed on each of the six panel structures A–F. For days 6 though 10, a 62.75 lb. load was imposed on the panel structures A–F. For the final five days, a 93.75 lb. load was imposed on the panel structures A–F. FIG. 9 graphically illustrates the downward deflection or sag experienced by each of the panel structures. As can be seen from FIG. 9, the heaviest panel structures, panel structure B and panel structure A were the worst performers with the greatest amount of downward deflection while the panel structures made in accordance with this disclosure, panel structures C–F, experienced the least amount of deflection. Panel structures E and F were the best performers, with the least amount of deflection even though they are the lightest of the six panel structures. The superior performance of panel structures E and F is attributed to the inclusion of the transverse ribs 33 in the lateral beams 12–14. However, the panel structures C and D also performed better than the conventional panel structures A and B despite not including the transverse ribs 33.

Figure 3:
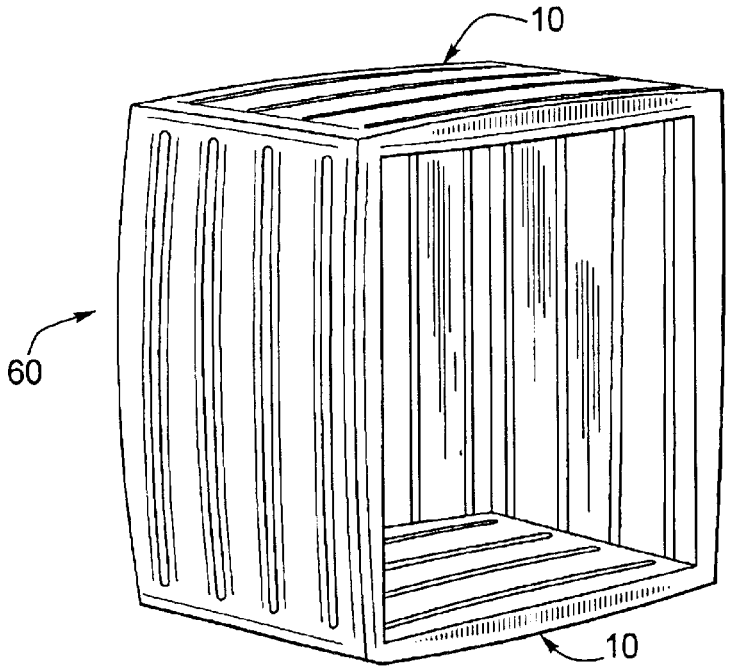
FIG. 3 illustrates the panel structure of FIG. 1 as combined with four other similar panel structures to form a box-like structure.

As shown in FIGS. 2 and 3, the improved panel structure 10 disclosed herein can be incorporated into a shelving 50 as shown in FIG. 2 or a box-like structure 60 as shown in FIG. 3.

While only certain embodiments have been set forth, alternative embodiments and various modifications will be apparent from the above description to those skilled in the art. These and other alternatives are considered equivalents and within the spirit and scope of this disclosure.

What is claimed is:

1. A panel structure comprising:

a first panel, a second panel spaced apart from the first panel, the second panel comprising a plurality of lateral beams extending from the second panel towards the first panel and connecting the second panel to the first panel, each beam defining a lateral slot extending through the second panel and towards the first panel, the second panel comprising a plurality of transverse ribs, each transverse rib extending through one of the lateral slots.

2. The panel structure of claim 1 wherein the first panel is further connected to the second panel by a front wall and a rear wall.

3. The panel structure of claim 1 wherein each transverse rib has an average lateral width, the average lateral width of the transverse ribs disposed toward a lateral center of the first panel being greater than an average lateral width of the transverse ribs disposed closer to the front or rear walls.

4. The panel structure of claim 1 wherein each transverse rib has a bottom edge that extends from one side of its respective lateral slot to an opposite side thereof, each bottom edge of each rib being arched upward towards the first panel.

5. The panel structure of claim 1 wherein each transverse rib has a top edge that extends from one side of its respective lateral slot to an opposite side thereof, each top edge of each rib being arched downwards away from the first panel.

6. The panel structure of claim 1 wherein the panel structure is blow molded.

7. The panel structure of claim 1 wherein the first panel further comprises a plurality of grooves, each groove being in alignment with one of the lateral beams.

8. The panel structure of claim 1 wherein the first panel is arched upward away from the second panel.

9. The panel structure of claim 8 wherein the second panel is flat.

10. The panel structure of claim 8 wherein the first panel is further connected to the second panel by two side walls, each sidewall further connecting the front wall to the rear wall.

11. The panel structure of claim 1 wherein the first panel is further connected to the second panel by a front wall and a rear wall.

12. The panel structure of claim 11 wherein the front wall is arched.

13. A panel structure comprising:

a first panel, a second panel spaced apart from the first panel, the second panel comprising a plurality of lateral beams extending from the second panel towards the first panel and connecting the second panel to the first panel, each beam defining a lateral slot extending through the second panel and towards the first panel, the first panel further comprising a plurality of grooves, each groove being in alignment with one of the lateral beams.

14. The panel structure of claim 13 wherein the second panel further comprises a plurality of transverse ribs, each transverse rib extending through one of the lateral slots.

15. The panel structure of claim 14 wherein each transverse rib has a bottom edge that extends from one side of its respective lateral slot to an opposite side thereof, each bottom edge of each rib being arched upward towards the first panel.

16. The panel structure of claim 14 wherein each transverse rib has a top edge that extends from one side of its respective lateral slot to an opposite side thereof, each top edge of each rib being arched downwards away from the first panel.

17. The panel structure of claim 13 wherein the first panel is arched upward away from the second panel.

18. The panel structure of claim 13 wherein each transverse rib has an average lateral width, the average lateral width of the transverse ribs disposed toward a lateral center of the first panel being greater than an average lateral width of the transverse ribs disposed closer to the front or rear walls.

19. The panel structure of claim 13 wherein the panel structure is blow molded.

20. A panel structure comprising:

a first panel, a second panel spaced apart from the first panel, the second panel comprising a plurality of lateral beams extending from the second panel towards the first panel and connecting the second panel to the first panel, each beam defining a lateral slot extending through the second panel and towards the first panel, the first panel is arched upward away from the second panel.

21. The panel structure of claim 20 wherein the second panel is flat.

22. The panel structure of claim 21 wherein the front wall is arched.

23. The panel structure of claim 21 wherein the first panel is further connected to the second panel by two side walls, each sidewall further connecting the front wall to the rear wall.

24. The panel structure of claim 20 wherein the second panel further comprises a plurality of transverse ribs, each transverse rib extending through one of the lateral slots.

25. The panel structure of claim 24 wherein each transverse rib has an average lateral width, the average lateral width of the transverse ribs disposed toward a lateral center of the first panel being greater than an average lateral width of the transverse ribs disposed closer to the front or rear walls.

26. The panel structure of claim 24 wherein each transverse rib has a bottom edge that extends from one side of its respective lateral slot to an opposite side thereof, each bottom edge of each rib being arched upward towards the first panel.

27. The panel structure of claim 24 wherein each transverse rib has a top edge that extends from one side of its respective lateral slot to an opposite side thereof, each top edge of each rib being arched downwards away from the first panel.

28. The panel structure of claim 20 wherein the first panel further comprises a plurality of grooves, each groove being in alignment with one of the lateral beams.

29. The panel structure of claim 20 wherein the second panel is flat.

30. The panel structure of claim 20 wherein the first panel is further connected to the second panel by a front wall and a rear wall.

31. The panel structure of claim 30 wherein the front wall is arched.

32. The panel structure of claim 30 wherein the first panel is further connected to the second panel by two side walls, each sidewall further connecting the front wall to the rear wall.

33. The panel structure of claim 20 wherein the panel structure is blow molded.

34. A panel structure comprising:

a first panel, a second panel spaced apart from the first panel and connected to the first panel by a front wall, a rear wall and two opposing sidewalls, the second panel comprising a plurality of lateral beams extending from the second panel towards the first panel and extending laterally between the sidewalls, the lateral beams further connecting the second panel to the first panel, each lateral beam defining a lateral slot extending through the second panel and towards the first panel, the second panel further comprising a plurality of transverse ribs, each transverse rib extending through one of the lateral slots.

35. The panel structure of claim 34 wherein the first panel further comprises a plurality of grooves, each groove being in alignment with one of the lateral slots.

36. The panel structure of claim 34 wherein the first panel is arched upward away from the second panel.

37. The panel structure of claim 36 wherein the second panel is flat.

38. The panel structure of claim 34 wherein the front wall is arched.

39. The panel structure of claim 34 wherein each transverse rib has an average lateral width, the average lateral width of the transverse ribs disposed toward a lateral center of the first panel being greater than an average lateral width of the transverse ribs disposed closer to the front or rear walls.

40. The panel structure of claim 39 wherein each transverse rib has a bottom edge that extends from one side of its respective lateral slot to an opposite side thereof, each bottom edge of each rib being arched upward towards the first panel.

41. The panel structure of claim 39 wherein each transverse rib has a top edge that extends from one side of its respective lateral slot to an opposite side thereof, each top edge of each rib being arched downwards away from the first panel.

42. The panel structure of claim 34 wherein the panel structure is blow molded.

43. A panel structure comprising:

an arched first panel, a flat second panel spaced apart from the first panel and connected to the first panel by a front wall, a rear wall and two opposing sidewalls, the second panel comprising a plurality of lateral beams extending upward from the second panel towards the first panel and extending laterally between the opposing sidewalls, the lateral beams being spaced apart and generally parallel to the rear wall, the lateral beams further connecting the second panel to the first panel, each lateral beam defining a lateral slot extending through the second panel and towards the first panel, the second panel further comprising a plurality of transverse ribs, each transverse rib extending through one of the lateral slots, each transverse rib having an average lateral width, the average lateral width of the transverse ribs disposed toward a lateral center of the first panel being greater than an average lateral width of the transverse ribs disposed closer to the front or rear walls, each transverse rib has a bottom edge that extends from one side of its respective lateral slot to an opposite side thereof, each bottom edge of each rib being arched upward towards the first panel, the first panel further comprising a plurality of grooves, each groove being in alignment with one of the lateral slots.

44. The panel structure of claim 43 wherein the panel structure is blow molded.

* * * * *

UNITED STATES PATENT AND TRADEMARK OFFICE

CERTIFICATE OF CORRECTION

PATENT NO. : 6,826,887 B2
APPLICATION NO. : 10/376803
DATED : December 7, 2004
INVENTOR(S) : Erik L. Skov It is certified that error appears in the above-identified patent and that said Letters Patent is hereby corrected as shown below:

Title Page
Column One
Item (73) Assignee:

After "Rubbermaid Incorporated," please delete "Wooter" and insert -- Wooster -- in its place.

Claim 21
Column 6, Line 3

Please delete "is arched" and insert -- arched -- in its place.

Signed and Sealed this

Twelfth Day of February, 2008

JON W. DUDAS
*Director of the United States Patent and Trademark Office*